United States Patent [19]

Frye et al.

[11] 4,442,617

[45] Apr. 17, 1984

[54] PHOTOGRAPHIC PRINT DISPLAY DEVICE

[76] Inventors: Bruce J. Frye, P.O. Box 783, Milltown, Wis. 54858; Paul A. Luedtke, Rte. 1, Box 594, Grantsburg, Wis. 54840

[21] Appl. No.: 459,757

[22] Filed: Jan. 21, 1983

[51] Int. Cl.[3] ..... G09F 1/12

[52] U.S. Cl. ..... 40/152.1; 40/10 D

[58] Field of Search ..... 40/10 R, 10 D, 124.1, 40/152.1, 152, 539; 248/441 A, 455, 459, 463, 465

[56] References Cited

U.S. PATENT DOCUMENTS

| | | | |
|---|---|---|---|
| 415,552 | 11/1889 | Orr | 40/152.1 |
| 438,185 | 10/1890 | Rosewater | 40/152.1 UX |
| 1,006,334 | 10/1911 | Wright | 248/459 |
| 1,097,009 | 5/1914 | Dill | 40/152.1 |
| 1,487,520 | 3/1924 | Ringler | 40/152.1 |
| 2,380,076 | 7/1945 | Scheyer | 40/152.1 |
| 2,409,814 | 10/1946 | Vargish | 40/152.1 |
| 2,480,918 | 9/1949 | Goldman | 40/152.1 |
| 2,746,191 | 5/1956 | Goldman | 40/152.1 |
| 3,275,281 | 9/1966 | Sampson | 248/465 |
| 3,553,865 | 1/1971 | Jones | 40/10 D |
| 3,977,112 | 8/1976 | Breer | 40/10 D |
| 4,242,817 | 1/1981 | Ballard | 40/152.1 |

*Primary Examiner*—Jay N. Eskovitz
*Attorney, Agent, or Firm*—Leo Gregory

[57] ABSTRACT

A photographic print and display device comprising a unitary transparent member having a self formed base, a body portion upstanding from the base at less than a right angle thereto, a self formed upper marginal portion reversely angled to retain the upper edge portion of a photographic print, a portion struck from the base bendable on an axis at right angles to body portion and being adjacent thereto and supporting it and the print retained thereby at an angle less than a right angle.

2 Claims, 10 Drawing Figures

FIG. 1
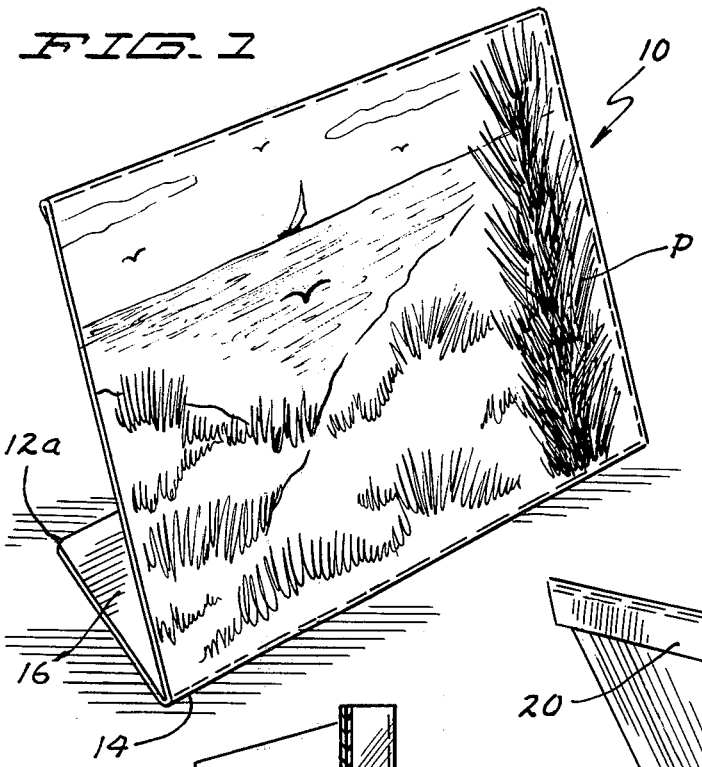
FIG. 2
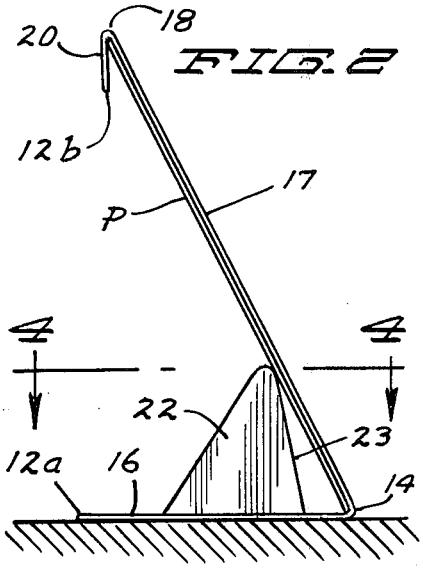
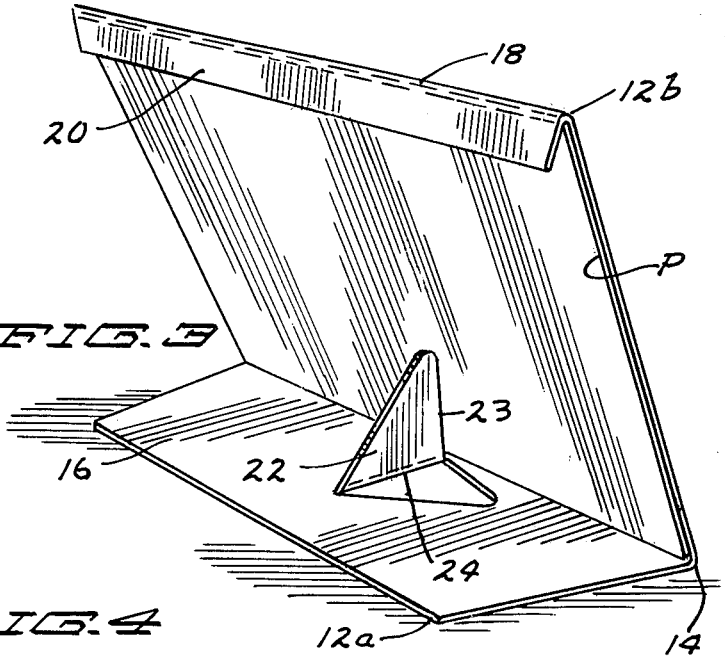
FIG. 3
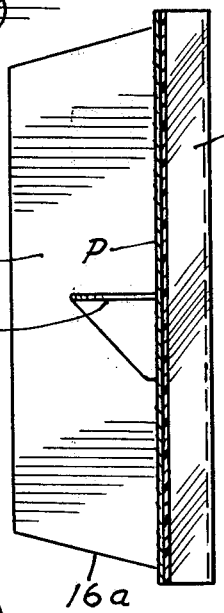
FIG. 4
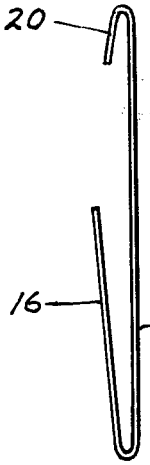
FIG. 6
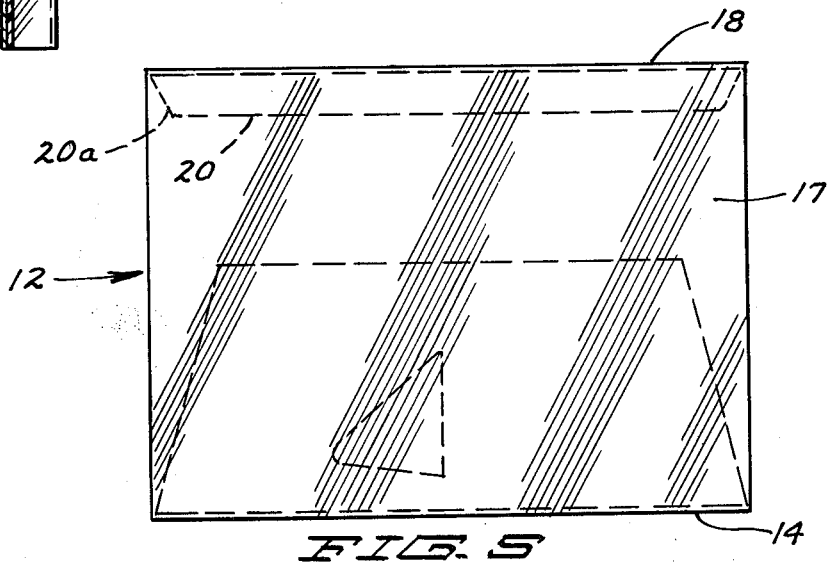
FIG. 5

PHOTOGRAPHIC PRINT DISPLAY DEVICE

BACKGROUND OF THE INVENTION

1. Field of the Invention

This invention relates to a unitary self formed photographic print display device.

2. Description of the Prior Art

Easel type of display devices as for photographic prints are common in the art and in general require the assembly of two or more parts as in the case of U.S. Pat. Nos. 1,097,009; 2,746,191 and 4,242,817.

SUMMARY OF THE INVENTION

It is desirable to have a unitary self formed photographic print display device. It is also desirable to have such a print display device as may be used as a self standing display device or it may be collapsed into a flat condition to be carried out in a wallet or in a pocket secretary.

It is an object of this invention therefore to provide a photographic print display device formed of a transparent blank adapted to have a base portion and an upstanding print retaining and display portion.

It is another object of this invention to provide a substantially rectangular blank of a suitable plastic sheet material pre-creased to form a base portion supporting the remainder of said blank at an upright angled position and a pre-creased upper marginal portion adapted to be reversely folded to retain the upper edge portion of a photographic print and a portion struck from said base portion and bent on an axis at right angles to said upright portion and being adjacent thereto to support the same in a suitably angled position and to secure therebetween the print displayed.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a front view in perspective displaying a photographic print;

FIG. 2 is a view in side elevation;

FIG. 3 is a rear view in perspective;

FIG. 4 is a view in horizontal section taken on line 4—4 of FIG. 2 as indicated;

FIG. 5 is a view in front elevation;

FIG. 6 is a view of an alternate position in end elevation;

DESCRIPTION OF A PREFERRED EMBODIMENT

Figure 7:
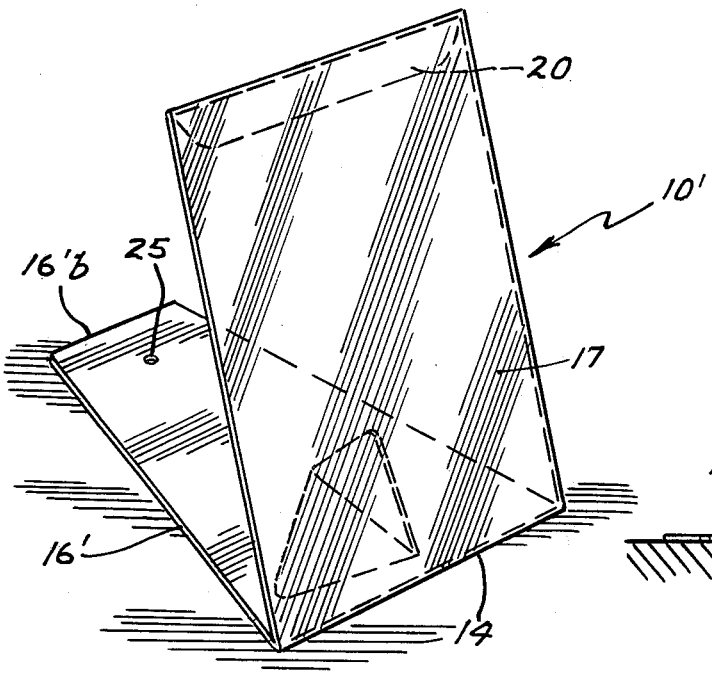
FIG. 7 is a view of a modification in perspective.
Figure 8:
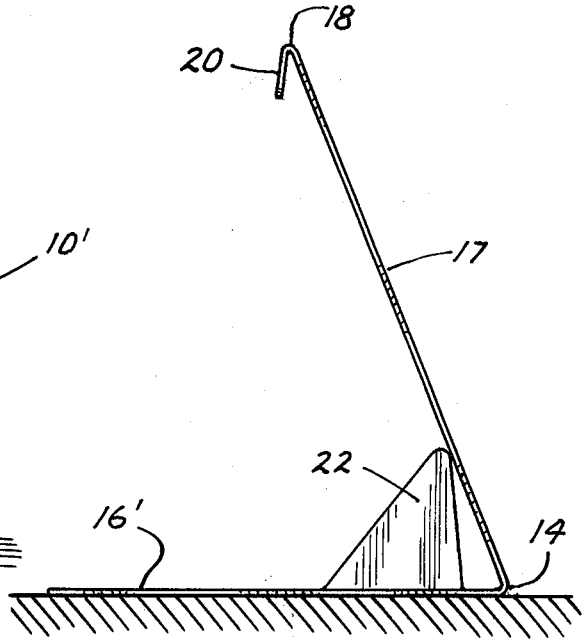
FIG. 8 is a view of said modification in end elevation.

Referring to the drawings, the device herein is indicated generally by the reference numeral 10 and it is seen that the device is formed of a substantially rectangular blank 12 of a suitable transparent plastic sheet material such as of a fairly rigid vinyl or of polycarbonate, as examples.

Said blank is pre-creased at 14 transversely of said blank spaced sufficiently from the end 12*a* thereof to provide a base portion 16 sufficient in length to support the remainder of said blank in an upstanding position.

A second transverse crease 18 is formed spaced from the upper end 12*b* forming the flap portion or flap 20 which is reversely folded upon said crease 18.

For purpose of appearance and not for limitation said base portion and flap are shown tapered as at 16*a* and 20*a* and they may have other design configurations and the rectangular upstanding body portion 17 is formed therebetween.

Referring to the base portion 16, a triangular tongue portion 22 is struck therefrom folded at the crease 24 which forms its base leg. Said struck-out portion is spaced from said crease 14 a sufficient distance such that with said struck-out portion is angled upwardly at a right angle to said base, that the upturned leg 23 bears against said upstanding body portion 17 to position it at a desirable angle and to bear against it sufficiently to retain therebetween the photographic print P as held and displayed by said device.

With respect to the modification 10' of FIGS. 7–10, the structure is substantially the same as that above described and like reference numerals are used to indicate like parts. A modification of a part is indicated by a like reference numeral with a prime added. The base portion indicated at 16' is lengthened sufficiently to extend to and have its end portion 16'*b* be retained under the flap 20.

Figure 10:
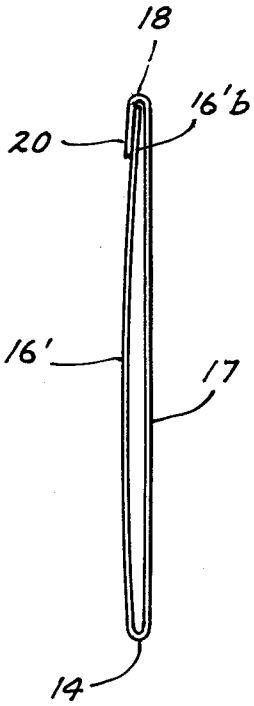
FIGS. 9 and 10 are views of said modification in front and side elevation in collapsed or folded up condition.
Figure 9:
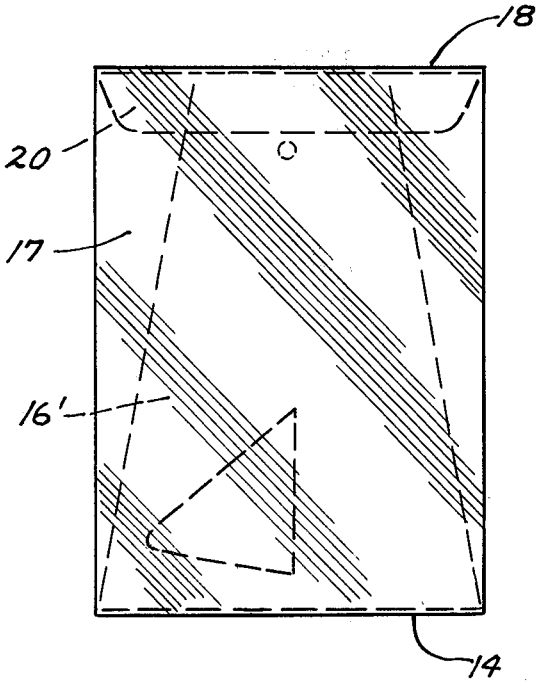

Hence, the modification is seen to be a self standing display device and as an illustration of a suggested use thereof is shown in a flat self locked position in FIGS. 9 and 10 as to be disposed conveniently into a wallet or pocket secretary. However, said suggested use is not to be construed as a limitation on the size of said modification.

The use of the device herein is believed to be well understood from the description given.

The device will be pre-formed as indicated in FIGS. 5 and 6. It is readily put into operating position by pressing outwardly or upwardly the struck-out tongue portion 22, the same being raised on the crease 24 to bear against the body portion 17 and position it at a predetermined angle. A print P is simply slipped into place along the underside of said body portion under the flap 20 to be lodged between the forward leg 23 of the angled struck-out tongue 22 and the adjacent body portion 17. It is noted in FIG. 4 that the device may be positioned upstanding from a side edge thereof.

Thus, the device is pre-formed for ready packaging and is very readily put into a self standing operating or display position.

The modification of FIGS. 7–10 comprises the same basic structure as the device 10 for a self standing display position and in an embodiment thereof here illustrated by merely inserting the end portion 16'*b* of the base 16 under the flap 20, the device is reduced to a very flat condition as for mailing or to be easily insertable as into a wallet or pocket secretary.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A unitary self standing device for displaying a photographic print, comprising a single layer planar blank in plan of a suitable material, a transverse crease of said blank defining a base portion, said base portion being angled along said crease at less than a right angle relative to the remaining portion of said blank, a second transverse crease spaced from the upper edge portion of said blank forming a flap of narrow width, said flap being angled outwardly relative to the adjacent remaining portion of said blank, the body portion of said blank being formed between said first and second mentioned creases, a portion struck from said base portion adjacent said first mentioned crease bendable on an axis at right angles to said first mentioned crease, and the leading edge of said struck portion being angled to engage and position said body portion at a desirable viewing angle.

2. The structure of claim 1, wherein said base portion is of such length as to extend to underlie said flap.

* * * * *